US005681179A

United States Patent [19]

Lane

[11] Patent Number: 5,681,179

[45] Date of Patent: Oct. 28, 1997

[54] MODULAR EXTENSION CORD SYSTEM

[76] Inventor: Alain Gerard Lane, P.O. Box 149, St. Eustatius, Netherlands Antilles

[21] Appl. No.: 574,338

[22] Filed: Dec. 18, 1995

[51] Int. Cl.[6] ..... H01R 4/24

[52] U.S. Cl. ..... 439/393; 439/427

[58] Field of Search ..... 439/393, 425, 439/426, 427, 638, 650, 655, 32, 209

[56] References Cited

U.S. PATENT DOCUMENTS

| | | | |
|---|---|---|---|
| 460,725 | 10/1891 | Markle | 174/88 R |
| 3,517,112 | 6/1970 | Wahl | 439/427 |
| 3,659,247 | 4/1972 | Chaney et al. | 439/32 |
| 4,032,210 | 6/1977 | Vogt | 439/393 |
| 4,571,018 | 2/1986 | Annoot | 439/650 |
| 4,655,520 | 4/1987 | Cummings | 439/111 |
| 4,875,871 | 10/1989 | Booty, Sr. et al. | 439/209 |
| 4,990,098 | 2/1991 | Neidecker | 439/207 |
| 5,503,568 | 4/1996 | Pryce | 439/427 |

*Primary Examiner*—Gary F. Paumen
*Assistant Examiner*—Tho D. Ta
*Attorney, Agent, or Firm*—Sanford J. Asman

[57] ABSTRACT

The present invention uses molded components to receive the ends of electrical zip cord. Elongated contact pins which are molded into the components are inserted axially into the ends of the stranded conductors at the end of the zip cord making positive electrical contact to the conductors. Ridged portions within the molded components receive, grip, and retain the insulator on the outer portion of the zip cord, thereby separating the functions of electrical gripping and mechanical contact in the present invention.

26 Claims, 7 Drawing Sheets

MODULAR EXTENSION CORD SYSTEM

BACKGROUND OF THE INVENTION

1. Field of the Invention

The present invention relate to electrical devices. In particular, the invention relates to an improved system of electrical connectors used to carry and distribute AC power. More specifically, the invention relates to a modular extension cord system used to carry and distribute AC power.

2. Description of the Prior Art

Electrical connectors used to carry and distribute AC power have been known for many years. A typical AC extension cord has a male component (plug) at one end and a female component (socket) at the other end. The plug and socket are typically joined by a molded two conductor flattened wire cable generally called "lamp cord" or "zip cord". As is well known in the art, the plug and socket may be molded over the zip cord, in which case the extension cord has a predetermined length. Preformed extension cords are typically available in lengths of 6, 8, 10, or 12 feet.

An alternative to manufactured electric extension cords are extension cords which are made by users using zip cord of arbitrary length together with plugs and sockets which are constructed to be connected to the zip cord. Usually, such plugs and sockets are made in two components, an inner component have an opening adapted to receive one end of the zip cord and to be clamped down end such that conductive metal pieces pierce the zip cord insulation and make contact to the conductors contained therein. Once the inner component has been attached to the zip cord it is inserted into an outer component, which has typically been slid onto the zip cord in advance. Typically, the assembly of the devices of the prior art was then completed by the pushing the outer component onto the partially assembled inner component into which the zip cord had been placed.

One problem with the devices of the prior art were that the conductive metal portions which were intended to pierce the insulation of the zip cord would sometimes fail to do so. As a result, when an extension cord was fully assembled, it would not conduct electricity. Obviously, that is not a satisfactory result.

Another problem with the devices of the prior art was the absence of components other than plugs and sockets. Consequently, if there was any need to either extend an extension cord in length, or, alternatively, to branch off an extension cord for the purpose of having sockets in multiple, displaced locations, that was also not readily accommodated. In either of the foregoing situations it was typically necessary to add multiple extension cords, or, in the case of extending the length of an existing extension cord, a whole new extension cord using a new length of zip cord would have to be used. Thus, for example, in the case in which a fourteen foot long extension cord was needed to replace an existing twelve foot extension cord, either a new fourteen foot length of zip cord was needed (wasting the original twelve foot length) or a new two foot long extension cord would be needed. In either instance there was a problem, either with the wasted length of zip cord, in the first instance, or with the extra plug in connection (with the attendant possibility of unintentional disconnection in the other instance).

In the situation in which an extension cord had been needed to supply power to two locations, both displaced from the wall socket, in the past two extension cords were needed, either with one connected to the other, or with both connected to the wall socket.

Attempts which had been made previously to resolve some of these issues are illustrated in U.S. Pat. No. 4,875,871 entitled MODULAR ELECTRICAL CONDUCTOR SYSTEM which issued to D. J. Booty, et al. in which a system of specific components are used to do various types of interconnections. A problem with the system described therein is that the entire length of the conductors must consist of the special purpose components rather than the significantly less expensive zip cord that will be described herein. Similar problems with earlier modular systems are illustrated in U.S. Pat. No. 4,655,520 entitled ELECTRICAL DISTRIBUTION SYSTEM AND CONNECTOR THEREFOR which issued to J. H. Cummings; in U.S. Pat. No. 3,659,247 entitled MODULAR CONDUCTOR SYSTEM which issued to L. R. Chaney, et al.; and in U.S. Pat. No. 460,725 entitled INSULATION FOR ELECTRIC WIRES which issued to J. R. Markle in 1891. As illustrated in these patents, for over 100 years attempts to solve the problem of providing an efficient, yet inexpensive modular electrical conductor system have been made.

There have been efforts made in the past to address certain markets. For example, in U.S. Pat. No. 4,990,098 which issued to R. Neidecker, et al. a current bar arrangement which uses a specially designed perforated, flat, two-wire cable for low voltage applications, i.e., halogen lighting, is described. A connector described therein includes contact pins which are intended to be axially inserted into the wires of the cable with some gripping supplied by ridged portions of the connector. Again, unlike the present invention, conventional, inexpensive zip cord is not used for the interconnections, and, further, only low voltage applications are addressed.

SUMMARY OF THE INVENTION

In view of the problems associated with the electric extension cords of the prior art, the present invention was devised to eliminate the problems heretofore addressed. In particular, the invention uses a series of molded components which are used to create an improved system for extending electrical power, while permitting common, inexpensive zip cord to be used between the connectors.

In particular the modular extension cord system of the present invention includes components receive an end of a piece of electrical zip cord. The end of the zip cord has at least a pair of exposed conductors, and the component of the modular extension cord system includes a first means for receiving an end of a piece of zip cord through an opening formed in one end thereof. The first means including a ratcheting ridged portion extending along an inner wall thereof. The ratcheting ridged portion has ratcheting ridges for contacting and retaining the outer insulator of a piece of zip cord inserted into the opening. As used herein, the term "ratcheting ridges" means that each of the ridges is sloped more gently on the side adjacent to the opening which receives the zip cord than the side closer to the contact pins, whereby the zip cord is biased into the receiving portion. Electrical contact is made to the exposed ends of the conductors in the zip cord by elongated contact pins which are aligned to axially extend into the exposed conductors at the end of the zip cord, thereby making electrical contact therewith.

DETAILED DESCRIPTION OF THE PREFERRED EMBODIMENTS

Figure 1:
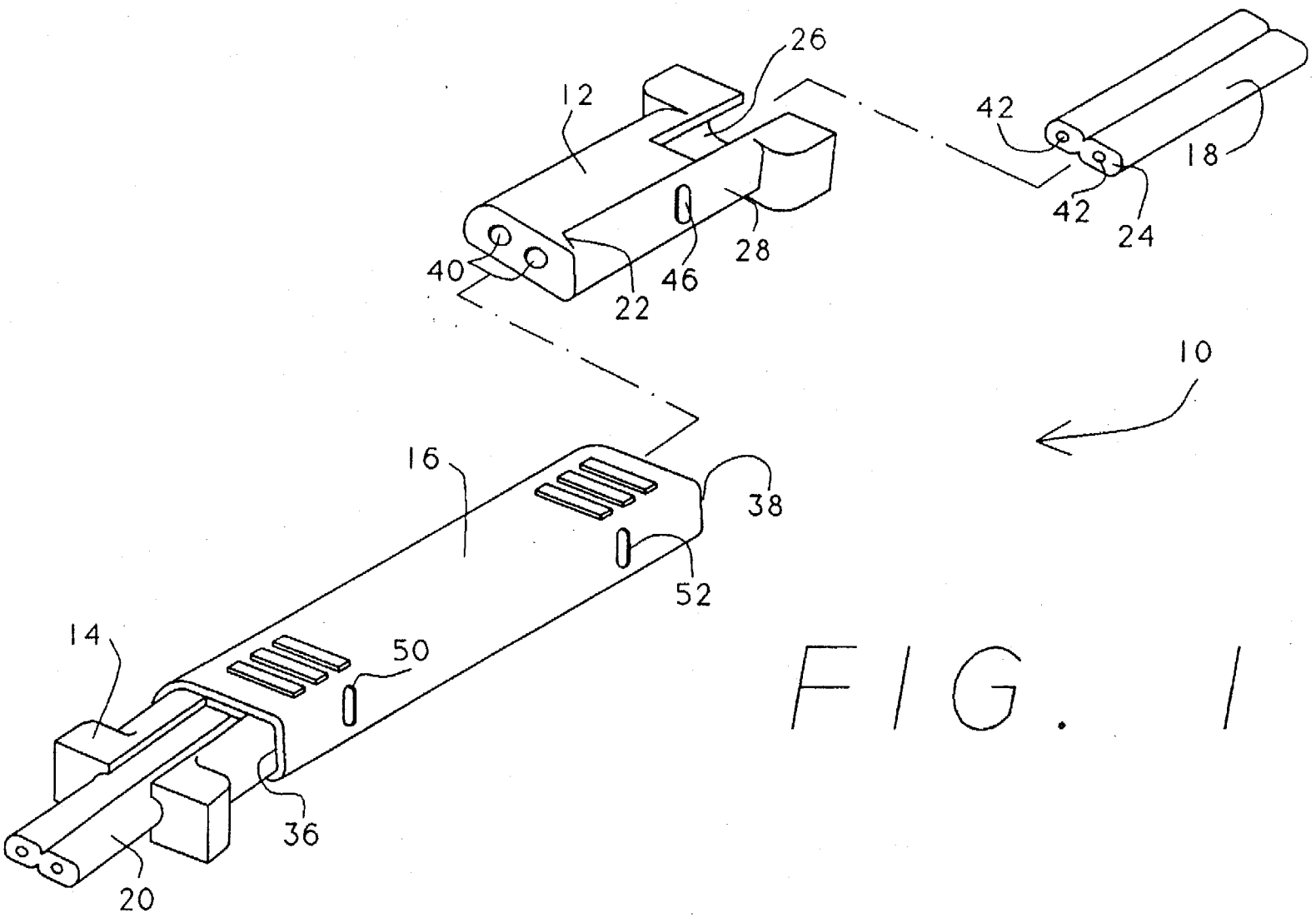
FIG. 1 is a perspective view showing the inline connector used to join two lengths of zip cord in the modular extension cord of the present invention.

As will be explained herein, the present invention relates to a series of modular devices which may be used in a modular extension cord system. While several different types of devices are described herein and with reference to the figures of the drawing, they all include the inventive concept of a component for a modular extension cord system including at least two components. In particular, there is, in each device described herein a first component which receives and grips the insulation along the side of a length of electrical zip cord, and a second component (which, as will be explained hereinafter, is sometimes a part of the first component) which provides electrical contact to the conductors within the zip cord by means of elongated, electrically conductive pins which are aligned axially to extend into the conductors which are exposed at the end of the zip cord (the end having first been inserted into an open end of the first component).

Figure 2:
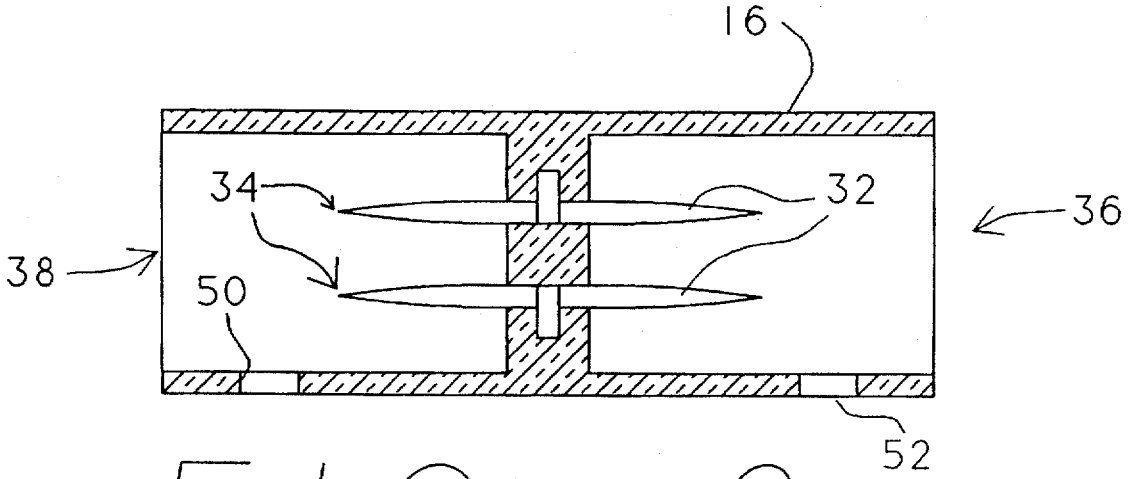
FIG. 2 is a cross-sectional view of the outer component of the inline connector or FIG. 1.
Figure 9:
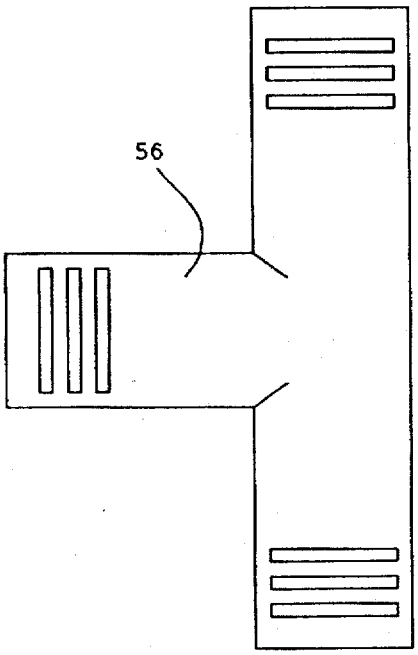
FIG. 9 is a top view of a flat "T" junction connector made in accordance with the present invention.
Figure 18:
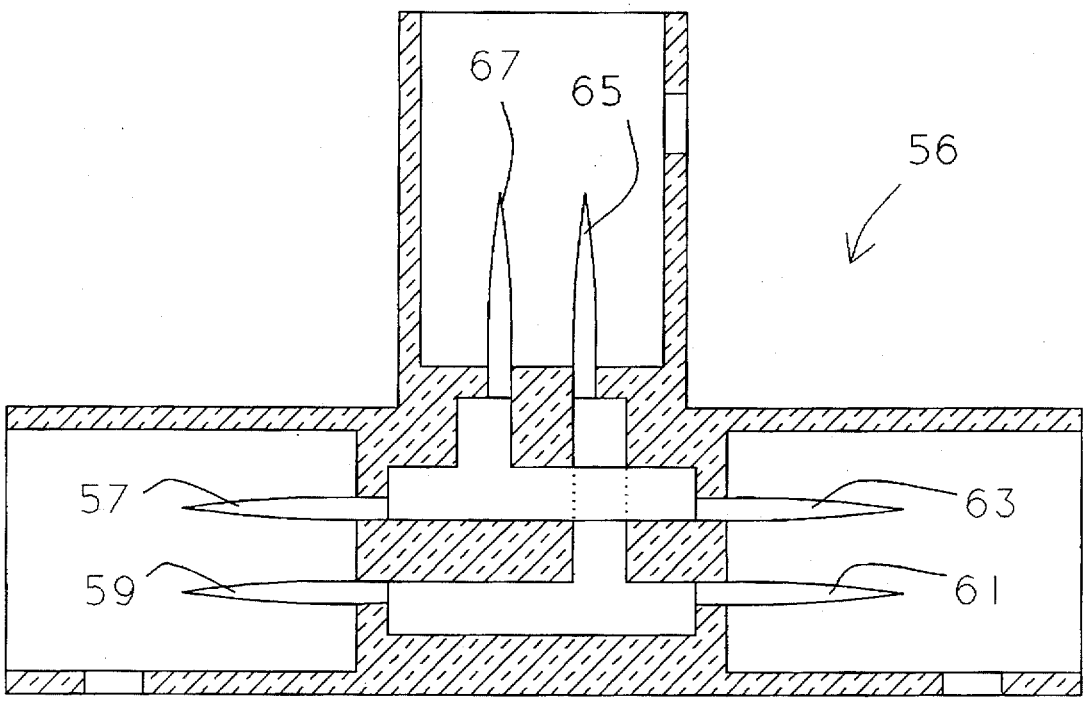
FIG. 18 is a cross-sectional top view of an outer component of the "T" junction connector made in accordance with the present invention.

With reference to FIG. 18, a cross-sectional top view of the "T" junction connector 56 of FIG. 9 is shown. As illustrated, sets of contact pins 57, 59, 61, 63, 65, 67, similar to the pins 32 illustrated in FIG. 2 are shown. The contact pins 57, 59, 61, 63, 65, 67 are arranged in a manner similar to the pins 32 of FIG. 2. Thus, pins 57, 63, and 67 are connected in parallel, and pins 59, 61, and 65 are connected in parallel.

Referring now to FIG. 1, a first embodiment of the present invention is an inline connector 10 made in accordance with the present invention. The inline connector 10 comprises two inner components 12, 14 and an outer component 16. The inline connector 10 is used to join two pieces of electrical lamp cord, referred to herein as "zip cord", 18, 20, used to carry AC power.

As will be understood by those skilled in the art, the use of the term "AC" herein is not intended to limit the invention to use solely with alternating current ("AC") applications. Instead, it is used to illustrate the best mode of the invention, and it is intended to illustrate that the present invention may be used with standard AC zip cord and at normal house voltages and currents, i.e., 120 volts AC in the United States. Thus, unlike similar items which may have existed in the prior art, neither special purpose electrical cable, nor low voltage requirements are imposed by the present invention.

Figure 3:
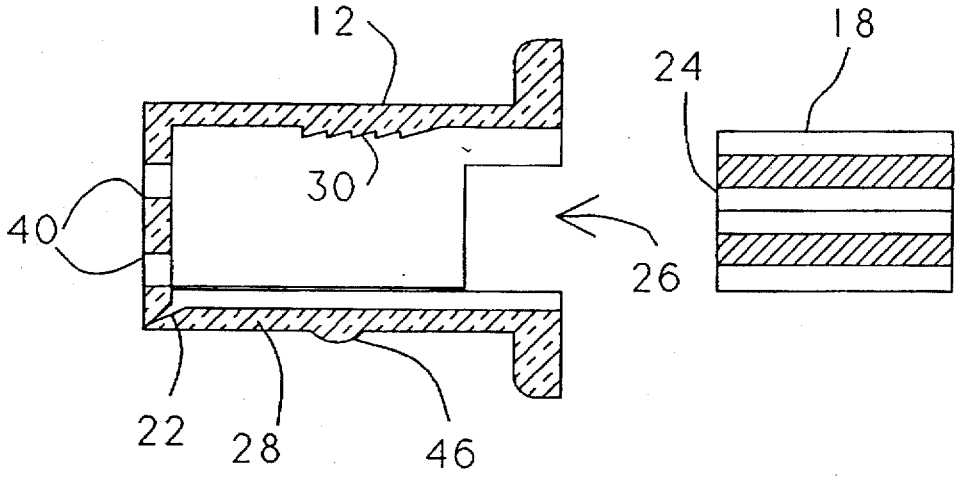
FIG. 3 is a cross-sectional view of one of the inner components of the inline connector of FIG. 1.
Figure 6:
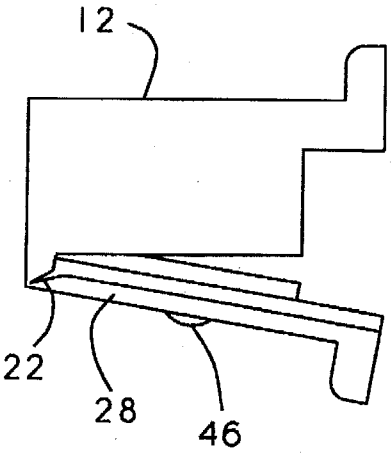
FIG. 6 is a top view of an inner component of the connector of FIG. 1 showing the opening of the hinge.
Figure 7:
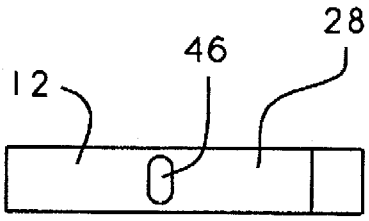
FIG. 7 is a side view of the inner component of the inline connector of FIG. 1 and FIG. 6.
Figure 4:
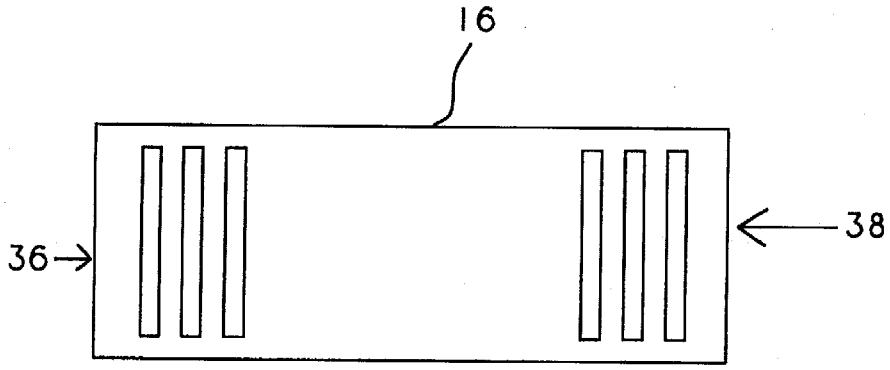
FIG. 4 is a top view of the outer component of the inline connector of FIG. 1.
Figure 5:
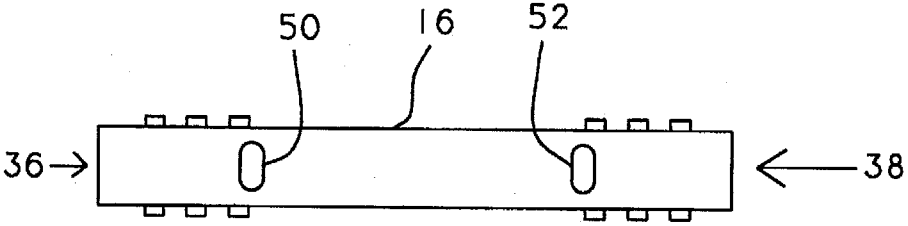
FIG. 5 is a side view of the outer component of the inline connector of FIG. 1 and FIG. 4.
Figure 8:
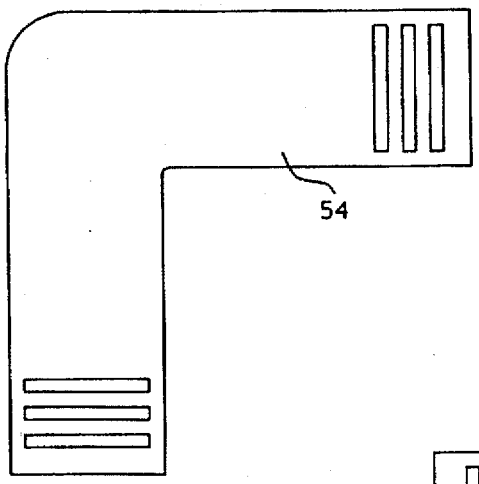
FIG. 8 is a top view of a 90 degree flat elbow connector made in accordance with the present invention.
Figure 10:
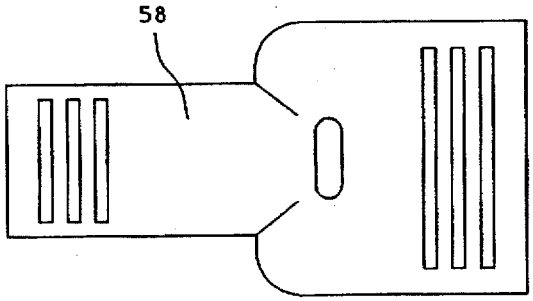
FIG. 10 is a top view of a two-into-one flat connector made in accordance with the present invention.

With reference to FIGS. 1–7, the inner component 12 is preferably molded from a plastic material to include a hinged portion 28 which facilitates the insertion of one end 24 of a piece of zip cord 18 through an opening 26 formed therein. Prior to the insertion of the zip cord 18 into the opening 26, the hinged portion 28 of the inner component 12 may be opened at the hinge 22, as illustrated in FIG. 6 to facilitate the insertion of the zip cord 18 therein. After inserting the zip cord 18 into the inner component 12, the hinged portion 28 is closed down onto the zip cord 18, thereby forcing the ridged inner gripping portion 30 (See FIG. 3) to close down on the outer insulator of the zip cord 18. As shown in FIG. 3 the gripping portion 30 is formed in a manner such that the ridges preferably have a saw-tooth configuration (which slopes inward), i.e., they are "ratcheting ridges" which bias the zip cord 18 into the inner component 12, thereby preventing it from readily pulling out.

Referring now to FIG. 2, a pair of electrically conductive metal contact pins 32 having sharpened ends 34 are formed in the outer component 16 of the inline connector 10. The contact pins 32 are located in the outer component 16 in parallel alignment with each :her, and they extend outward openings 36, 38 in the ends of the outer component 16. Accordingly, when the inner component 12, 14 are inserted into the openings 36, 38, the ends 34 of the contact pins 32 will be aligned with the openings 40 at the end of the inner components 12, 14 so that the pins 32 pass through the openings 40 and extend axially into the exposed ends of the stranded wire conductors 42 at the end 24 of the zip cord 18 (See FIG. 1), so they make positive electrical contact to the pins 32. Those skilled in the art will recognize that by using the elongated contact pins 32, the present invention insures positive electrical contact, unlike many of the devices used in the prior art in which electrical contact was dependent upon a metal piece which had to first radially pierce the outer insulator (whose job was to protect the inner conductor from electrical contact) before making electrical contact to the inner conductors.

When the inner components 12, 14 of the inline connector 10 are pushed fully into the openings 36, 38, they will reach a point where buttons 46 formed on their hinged portions 28 will be aligned with and received by openings 50, 52 formed on the outer component 16. At that point, the inner components 12, 14 will lock into place within the outer component 16, thereby completing the mechanical and electrical connection between the pieces of zip cord 18, 20.

Figure 11:
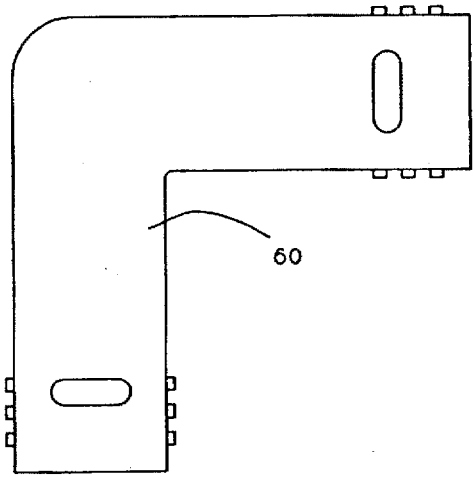
FIG. 11 is a top view of a 90 degree vertical elbow made in accordance with the present invention.

Referring now to FIGS. 8–11, top views of additional components of the modular extension cord system of the present invention are shown. These comprise a 90 degree flat elbow 54 (FIG. 8), a flat "T" junction 56 (FIG. 9), a two-into-one flat connector 58 (FIG. 10), and a 90 degree vertical elbow 60 (FIG. 11). As will readily be understood by those skilled in the art, the inner component 12 can be inserted into these units in order to join pieces of zip cord in any or several desired configurations.

Figure 12:
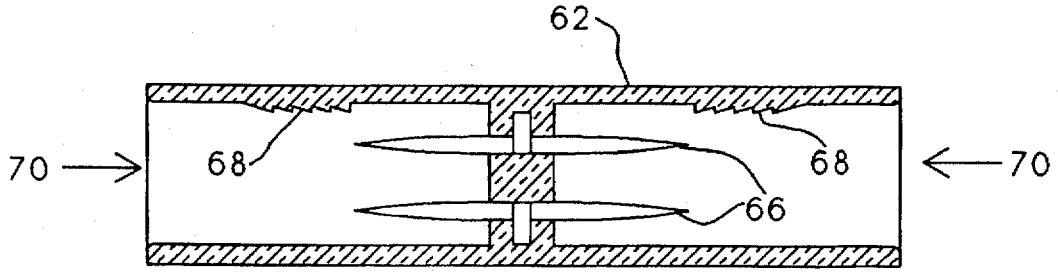
FIG. 12 is a cross-sectional top view of a one-time use inline connector made in accordance with the present invention.
Figure 13:
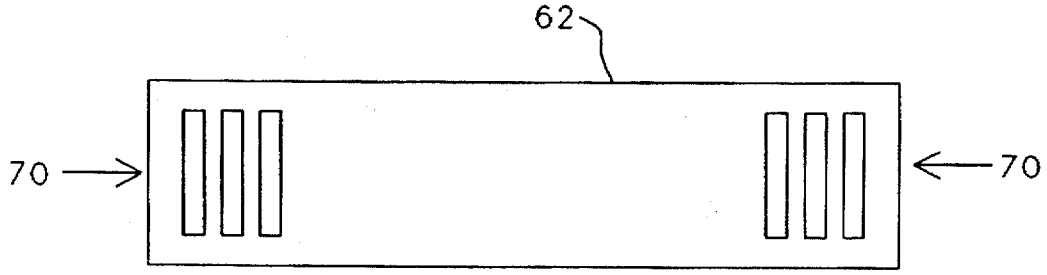
FIG. 13 is a top view of the one-time use inline connector of FIG. 12.
Figure 14:
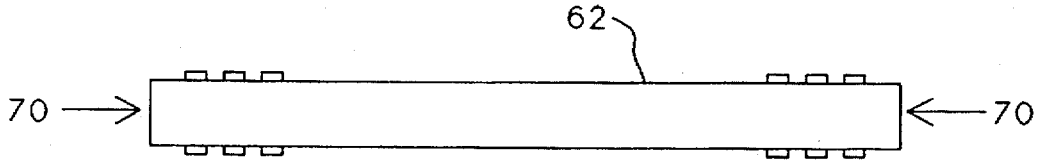
FIG. 14 is a top view of the one-time use inline connector of FIG. 12.

Sometimes, it may be desirable to minimize the size of a component of the modular extension cord system of the present invention. In such instances, a one-time inline connector 62, shown in top cross-sectional view in FIG. 12, may be used. The one-time inline connector 62 has only a single component in which pins 66 are used to make electrical contact and in which there are ridged portions 68 which grip the outer insulation on a pieces of zip cord (not shown) which are inserted into openings 70 at each end of the one-time connector 62. The one-time connector 62 is shown in top and side views in FIGS. 13 and 14, respectively.

Figure 15:
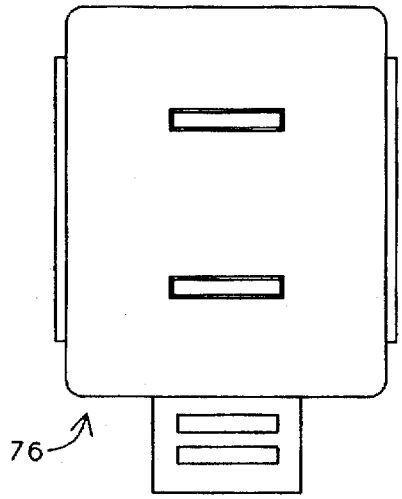
FIG. 15 is a top view of an AC socket made in accordance with the present invention.
Figure 17:
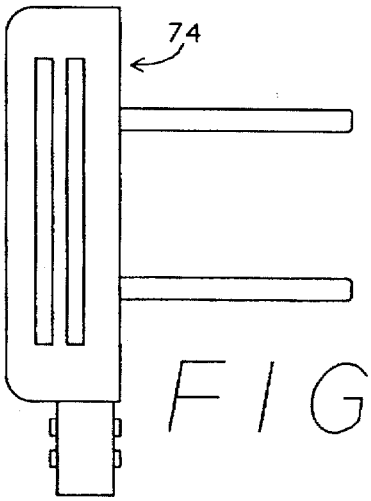
FIG. 17 is a side view of the AC plug of FIG. 16.
Figure 16:
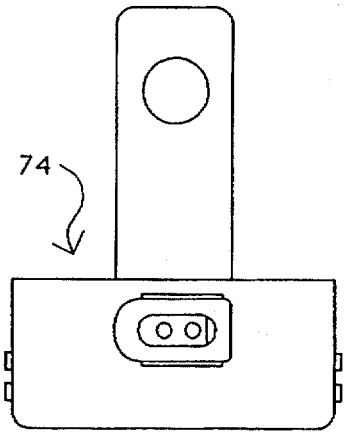
FIG. 16 is a top view of an AC plug made in accordance with the present invention.

With reference to FIGS. 15–17, an AC plug 74 and receptacle 76 made in accordance with the present invention are shown. As set forth above, the interior portions of these items 74, 76 may be made like the one-time connector 62 illustrated in FIG. 16.

While a number of components of the modular extension cord system of the present invention have been shown, those skilled in the art will recognize that numerous variations which employ the present invention can be made without departing from the spirit or scope of the present invention.

I claim:

1. A component for a modular extension cord system adapted to receive an end of a piece of electrical zip cord, said end having at least a pair of exposed conductors, said component comprising:

(a) at least one inner component being adapted to receive and retain a piece of zip cord, said inner component including first means for receiving an end of a piece of zip cord through an opening formed in one end thereof, said first means including a ratcheting ridged portion extending along an inner wall thereof, said ratcheting ridged portion having ratcheting ridge means for contacting and retaining the outer insulator of a piece of zip cord inserted into said opening; and (b) an outer component separate from said inner component, said outer component being adapted to receive and retain said inner component;

(c) electrical contact means comprising at least a pair of elongated contact pins which are aligned to axially extend into said exposed conductors at the end of said zip cord, thereby making electrical contact therewith, said contact pins being a part of said outer component, said inner component having an opening for admitting said zip cord and at least one opposed opening for admitting said contact pins therethrough when said inner component is inserted into said outer component.

2. The component for a modular extension cord system of claim 1 wherein said first means includes means for biasing the zip cord into said first means.

3. The component of claim 1, wherein said component has a shape and configuration adapted to join two pieces of zip cord which are in line with one another.

4. The component of claim 1, wherein said component has a shape and configuration adapted to join two pieces of zip cord which come together at about a 90 degree angle to one another.

5. The component of claim 1, wherein said component has a shape and configuration adapted to join three pieces of zip cord which come together to form a "T" configuration.

6. The component of claim 1, wherein said component has a shape and configuration adapted to join three pieces of zip cord, two of which enter said component from the same side, the third entering said component from the opposite side.

7. The component of claim 1, wherein said component has a shape and configuration adapted to join two pieces of zip cord which are in line with one another.

8. The component of claim 1, wherein said component has a shape and configuration adapted to join two pieces of zip cord which come together at about a 90 degree angle to one another.

9. The component of claim 1, wherein said component has a shape and configuration adapted to join three pieces of zip cord which come together to form a "T" configuration.

10. The component of claim 1, wherein said component has a shape and configuration adapted to join three pieces of zip cord, two of which enter said component from the same side, the third entering said component from the opposite side.

11. The component for a modular extension cord system of claim 1 wherein said ratcheting ridged portion of said first means includes means for biasing the zip cord into said first means.

12. The component for a modular extension cord system of claim 11 wherein said means for biasing the zip cord into said first means includes sloped portions on said ridges, whereby said ridges have a saw-tooth configuration.

13. The component for a modular extension cord system of claim 1 wherein said component is adapted to electrically and mechanically join at least two lengths of zip cord, wherein said component includes a pair of said first means, and wherein said elongated contact pins, which comprise said electrical contact means, each have two opposed elongated portions, each of said opposed elongated portions being adapted to extend into respective ones of said zip cord being joined.

14. The component of claim 13, wherein said component is adapted to join two lengths of zip cord, and said lengths are substantially aligned with one another, whereby said contact pins are comprised of a pair of substantially parallel, straight contact pins.

15. The component of claim 13 wherein said component is adapted to join two lengths of zip cord, and said lengths are not intended to be substantially aligned with one another, whereby said contact pins are comprised of a pair of substantially parallel contact pins, said contact pins having a configuration which is substantially the same as the outer configuration of said component.

16. The component of claim 13, wherein said component is adapted to join three lengths of zip cord, said contact pins having a number of pairs of elongated portions and a configuration which is substantially the same as the outer configuration of said component.

17. The component of claim 1, wherein said inner component further comprises a hinged portion which is hingedly attached to a wall having said at least one opening for admitting said contact pins, whereby said hinged portion can be opened to further facilitate the introduction into said inner component of said zip cord.

18. The component of claim 1, wherein said component is comprised of at least two inner components and a separate outer component, each of said inner components being adapted to receive and retain a piece of zip cord, said outer component being adapted to receive said inner components, said contact pins being a part of said outer component, each of said inner components having an opening for admitting said zip cord and at least one opposed opening for admitting said contact pins therethrough when said inner components are inserted into said outer component, whereby when said inner components are both inserted into said outer component, said pieces of zip cord are joined mechanically and electrically to one another.

19. The component of claim 18, wherein said component has a shape and configuration adapted to join three pieces of zip cord which come together to form a "T" configuration.

20. The component of claim 18, wherein said component has a shape and configuration adapted to join three pieces of zip cord, two of which enter said component from the same side, the third entering said component from the opposite side.

21. The component of claim 18, wherein said inner component further comprises a hinged portion which is hingedly attached to a wall having said at least one opening for admitting said contact pins, whereby said hinged portion can be opened to further facilitate the introduction into said inner component of said zip cord.

22. The component of claim 21, wherein said hinged portion may be closed down on said zip cord, whereby said zip cord will be urged into contact with said ratcheting ridged portion, thereby mechanically engaging said zip cord within said inner component.

23. The component of claim 22, wherein said hinged portion further comprises at least one retention means, and said outer portion includes at least one retaining means, whereby when said inner portion is received by said outer portion, said elongated pins extend into said inner portion and said retention means and said retaining means cooperate to retain said inner portion within said outer portion.

24. The component of claim 23, wherein said component has a shape and configuration adapted to join three pieces of zip cord, two of which enter said component from the same side, the third entering said component from the opposite side.

25. The component of claim 17, wherein said hinged portion may be closed down on said zip cord, whereby said zip cord will be urged into contact with said ratcheting ridged portion, thereby mechanically engaging said zip cord within said inner component.

26. The component of claim 25, wherein said hinged portion further comprises at least one retention means, and said outer portion includes at least one retaining means, whereby when said inner portion is received by said outer portion, said elongated pins extend into said inner portion and said retention means and said retaining means cooperate to retain said inner portion within said outer portion.

* * * * *